United States Patent [19]

Kawai et al.

[11] Patent Number: 4,964,815

[45] Date of Patent: Oct. 23, 1990

[54] ELECTRICAL CONNECTOR

[75] Inventors: Mitsuru Kawai; Masaru Yoshida; Yoshihiro Sasaki, all of Tokyo, Japan

[73] Assignee: Hirose Electric Co., Ltd., Tokyo, Japan

[21] Appl. No.: 404,504

[22] Filed: Sep. 8, 1989

[30] Foreign Application Priority Data

Oct. 4, 1988 [JP] Japan ..... 63-129621

[51] Int. Cl.[5] ..... H01R 13/658

[52] U.S. Cl. ..... 439/610; 439/906

[58] Field of Search ..... 439/607-610, 439/606, 906, 696, 731, 736, 752

[56] References Cited

U.S. PATENT DOCUMENTS 4,018,979 4/1977 Young ..... 439/610 X
4,457,576 7/1984 Cosmos et al. ..... 439/610
4,613,198 9/1986 Selvin et al. ..... 439/906 X
4,830,629 5/1989 Yoshimura ..... 439/610

FOREIGN PATENT DOCUMENTS 62-106484 7/1987 Japan .

*Primary Examiner*—Steven C. Bishop
*Attorney, Agent, or Firm*—Kanesaka & Takeuchi

[57] ABSTRACT

An electrical connector which includes an insulating housing (30) containing a plurality of contacts (40); a cylindrical member for enclosing and supporting the insulating housing; and an insulating jacket (50) molded around the cylindrical member and a terminated section of a cable (70). The cylindrical member is divided into two semi-cylindrical sections (10, 20) in a plane parallel to its axis. The semi-cylindrical section (10) has a recessed joint edge or mortise and the semi-cylindrical section (20) has a projected joint edge or tenon corresponding to the recessed joint edge.

8 Claims, 2 Drawing Sheets

ELECTRICAL CONNECTOR

BACKGROUND OF THE INVENTION

The present invention relates generally to electrical connectors and, more particularly, to an electrical connector having an insulating jacket integrally molded from an insulating material.

Electrical connectors of this type are disclosed in Japanese U.M. Patent Application Kokai Nos. 62-106484 and 62-10685. In these electrical connectors, the cylindrical member enclosing an insulating housing which contains contacts is made by bending a thin metal sheet and stamping lug members for engagemen with the insulating housing. The cylindrical member is then subjected to an integral molding to form an insulation jacket thereover.

However, such electrical connectors have the following disadvantages.

Since the cylindrical metal cover is made by stamping a number of lug members from a thin metal sheet and bending the metal sheet in the form of a cylinder, there are gaps at the seam and openings behind the lug members. Consequently, when an insulating jacket and a cable protection are formed by placing the cylindrical metal cover in a metal mold and injecting a plastic, the plastic flows into the metal cover through the seam and openings. The cylindrical metal cover can be deformed under the injection pressure of a plastic. The insulations of conductors can be melted under the heat of the entered plastic causing a short circuit between the wires or a wire and the metal cover. A conductor can even be broken under the pressure of an injected plastic. The plastic can spread into spaces between contacts and apertures of the insulating housing and adhere to the contact section of a contact causing a poor contact.

For electromagnetic interference (EMI) resistant connectors, the shield wires of a cable are soldered to the metal cover in the terminated area or the upper end of the metal cover. During the soldering operation, the insulation of a conductor within the metal cover can be melted under the soldering heat. Then, the insulation is further melted or the wire is broken under the heat and pressure of an injected plastic.

SUMMARY OF THE INVENTION

Accordingly, it is an object of the invention to provide an electrical connector having a cylindrical member into which no plastic can spread upon molding an insulation jacket.

According to the invention the above object is achieved by an electrical connector which includes an insulating housing containing a plurality of contacts; a cylindrical member for enclosing and supporting the insulating housing; and an insulating jacket molded around the cylindrical member and a terminated section of a cable, characterized in that the cylindrical member is divided into two semi-cylindrical sections in a plane parallel to its axis; one of the semi-cylindrical sections has a recessed joint edge and the other semi-cylindrical section has a projected joint edge corresponding to the recessed joint edge.

The joint sections are interlocked with the recessed and projected edges so that no resin of relatively high viscosity flows into the cylindrical member upon forming an insulating jacket.

Other objects, features, and advantages of the invention will be apparent from the following description when taken in conjunction with the accompanying drawings.

DESCRIPTION OF THE PREFERRED EMBODIMENT

Figure 1:
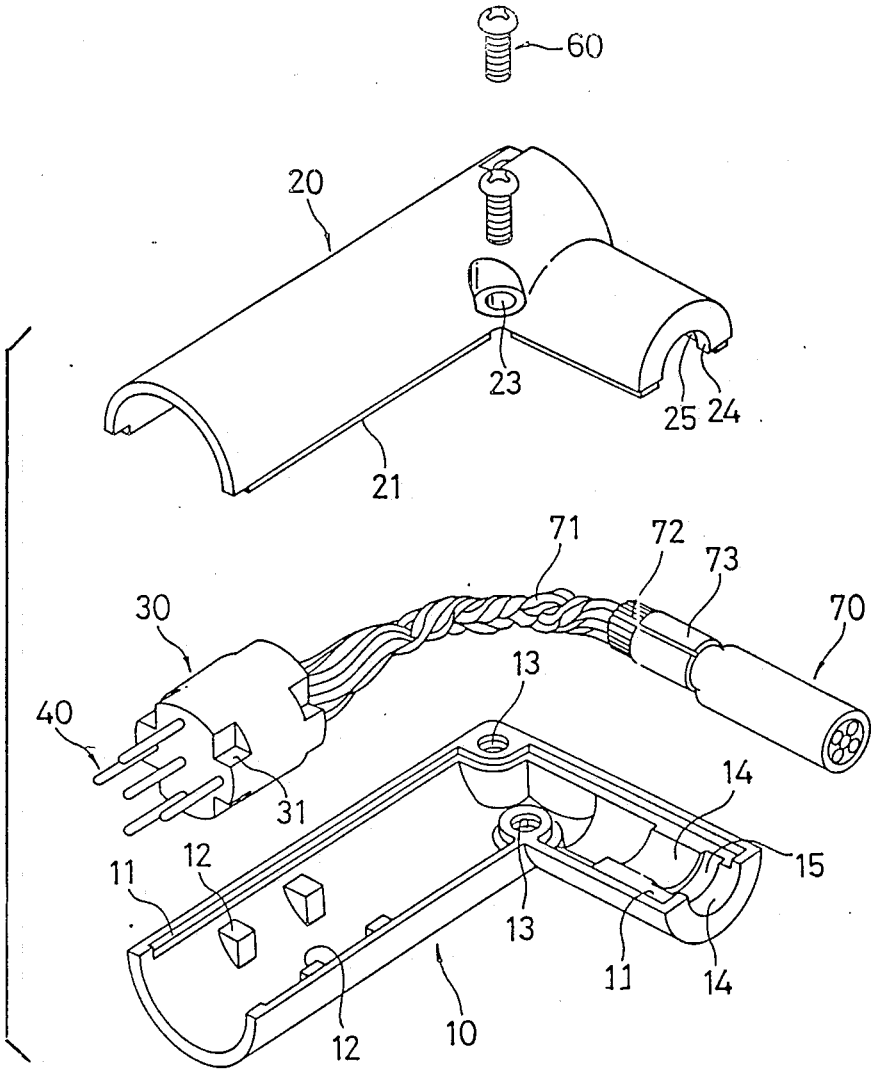
FIG. 1 is an exploded perspective view of an electrical connector before an insulating jacket is formed therearound according to an embodiment of the invention.
Figure 2:
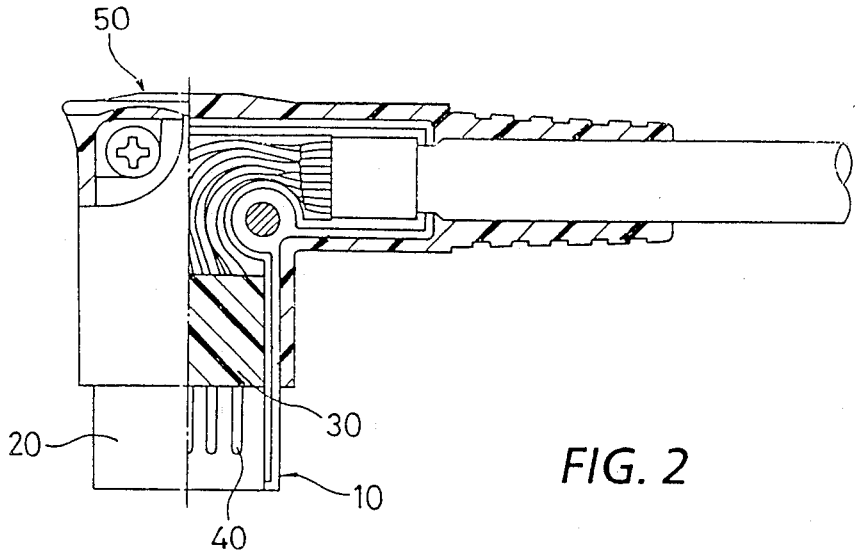
FIG. 2 is a partially secional view of the electrical connector after an insulating jacket is formed therearound.

In FIG. 1, an electrical connector includes a cylindrical member consisting of a lower cylindrical section 10, an upper cylindrical section 20, an insulating housing 30, contacts 40, and an insulating jacket 50 (FIG. 2).

The L-shaped lower and upper cylindrical sections 10 and 20 are made by die casting a conductive material. Alternatively, they may be molded from a plastic and then metal plating is applied thereto. The lower cylindrical section 10 has a pair of recessed inside edges 11 along almost the entire length to form joint sections. Four projections 12 are provided on the inside of the semi-cylindrical portion for engage with engaging recesses 31 of the insulating housing 30. A pair of threaded holes 13 are provided at the corner of the L-shaped cylindrical section 10 to receive bolts 60 for joining the upper cylindrical section 20 with the cable within the completed cylindrical member.

A semi-cylindrical cable retainer section 14 is provided a the right end of the L-shaped cylindrical section 10. The cable retainer section 14 has a circumferential channel 15 into which the cable jacket expands when the cable is held between the lower and upper cylindrical sections 10 and 20 thereby not only giving resistance against a pulling force which can be applied to the cabinet but also preventing further entrance of the plastic which enters through a gap between the cable and the termination end of the cylindrical member.

The upper cylindrical section 20 has a pair of projected inside edges 21 which are fitted into the recessed inside edges 11. The structure other than the above projected inside edges is substantially identical with that of the lower cylindrical section 10.

The insulating housing 30 is molded from an insulating material, such as a plastic, so as to contain a plurality of contacts 40. A plurality of engaging recesses 31 are provided on the insulating housing 30 for engagement with the projections 12 of each cylindrical section to prevent rotation and movement in the axial and vertical directions of the insulating housing 30 within the cylindrical member.

The insulating jacket 50 is molded from an insulating material, such as a plastic, integrally with the cylindrical member by placing the assembled upper and lower cylindrical sections 10 and 20 in a metal mold and injecting a resin therein.

The electrical connector according to the invention is made as follows.

(1) The sheath of an end portion of a cable 70 is removed to expose insulated conductors 71 of a predetermined length. The shield wires 72 are folded back, and a shield piece 73 is crimped around the shield wires 72 by means of a crimping tool (not shown). See FIG. 1.

Alternatively, a tape of copper or the like may be wrapped around the shield wires 72.

Figure 3:
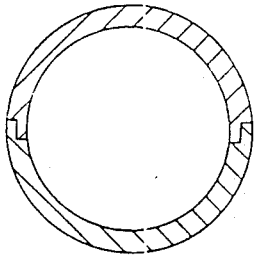
FIG. 3 is a cross section of a cylindrical member useful for the electrical connector.

(2) The front end of each conductor 71 is soldered or crimped to a contact 40. The terminated cable and housing assembly is placed between the lower and upper cylindrical sections 10 and 20, which are joined together with bolts 60 such that the projected inside edges 21 fit in the recessed inside edges 11 producing no or few gaps between the sections. See FIG. 3. The diameters of the cable 70 and the shielding piece 73 are made slightly greater than the inside diameter of the cable retainer sections 14 and 24 so that the shield piece 73 and the cable 70 are firmly held between the cylindrical sections 14 and 24 thereby ensuring shield effects.

(3) The assembled cylindrical member is placed in a metal mold, and a resin is injected in profiled areas around part of the cylindrical member and the cable to form an insulating jacket 50.

Figure 4:
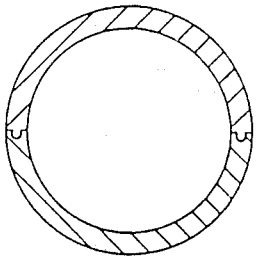
FIGS. 4 and 5 are cross sections of cylindrical members according to other embodiments of the invention.
Figure 5:
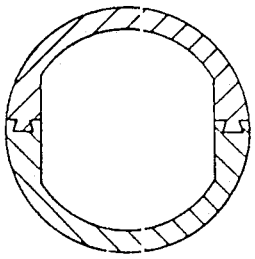

Alternatively, the joint sections of the cylindrical member may be made in the form of a tenon-and-mortise joint as shown in FIG. 4 or a dovetail joint as shown in FIG. 5. The cylindrical member may be made by bending a metal thin sheet and interlocking the stepped edges of opposite ends.

According to the invention there are provided the following advantages.

(1) The joints of the cylindrical member are so tight that no resin enters the cylindrical member upon forming an insulating jacket thereby preventing any short circuit between wires or a wire and the cylindrical member caused by the molten insulation of conductors.

(2) The wall of a cylindrical member is sufficiently thick to withstand the molding force of a resin thereby eliminating the possibility of collapse of the cylindrical member under the resin pressure.

(3) Since no resin flows into the cyindrical member, no resin adheres to the contacts thereby eliminating the possibility of poor contact.

(4) The shielding wires of a cable are connected to the cylindrical member without using any solder thereby eliminating not only the soldering operation but also undesirable conduction of the soldering heat to conductors.

We claim:

1. An electrical connector comprising:

an insulating housing containing a plurality of contacts and having a plurality of engaging recesses;

a cylindrical member for enclosing and supporting said insulating housing and consisting of first and second semi-cylindrical sections, said first semi-cylindrical section having a recessed joint edge and said second semicylindrical section having a projected joint edge to fit into said recessed joint edge when said two semi-cylindrical sections are jointed together, said cylindrical member having a plurality of engaging projections on a first end portion thereof for engagement with said engaging recesses of said insulating housing to restrict rotation and movement of said insulating housing with respect to said cylindrical member; and an insulating jacket molded around at least part of said cylindrical member and a terminated area of said cable.

2. The electrical connector of claim 1, wherein said projected and recessed joint edges are a tenon and a mortise respectively.

3. The electrical connector of claim 1, wherein said projected and recessed joint edges are a dovetail and a mortise.

4. The electrical connector of claim 1, wherein said cylindrical member is die cast.

5. The electrical connector of claim 1, wherein said cylindrical member has cable retainer means at a second end portion thereof opposite to said first end portion, said cable retainer means having a circumferential channel into which a cable jacket expands when said first and second semi-cylindrical sections are joined together, therelby not only providing resistance to a pulling force which can be applied to said cable but also preventing further entrance of a molding material.

6. The electrical connector of claim 1, wherein said first and second semi-cylindrical sections are bolted together.

7. The electrical connector of claim 1, wherein said cylindrical member is L-shaped.

8. The electrical connector of claim 5, wherein said cable retainer means is made so that its inside diameter is slightly smaller than the diameter of said cable jacket.

* * * * *